US007083460B2

(12) United States Patent
Wu

(10) Patent No.: US 7,083,460 B2
(45) Date of Patent: Aug. 1, 2006

(54) CABLE END CONNECTOR HAVING A LATCHING DEVICE AND AN UNLATCHING ACTUATOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/926,655

(22) Filed: Aug. 25, 2004

(65) Prior Publication Data

US 2006/0046555 A1 Mar. 2, 2006

(51) Int. Cl.
*H01R 13/627* (2006.01)

(52) U.S. Cl. ..... 439/357

(58) Field of Classification Search ..... 439/357–358, 439/352–354, 350, 387
See application file for complete search history.

(56) References Cited

U.S. PATENT DOCUMENTS 4,961,711 A * 10/1990 Fujiura et al. ..... 439/357
6,585,536 B1 7/2003 Wu
6,592,391 B1 * 7/2003 Wu ..... 439/352
6,655,979 B1 12/2003 Lee

* cited by examiner

*Primary Examiner*—Javaid H. Nasri
(74) *Attorney, Agent, or Firm*—Wei Te Chung

(57) ABSTRACT

A cable end connector (1) includes an insulative housing (2), a number of contacts (3) received in the insulative housing, a number of vertically extending wires (4) electrically connecting with the contacts, a cover (5) mounted to the insulative housing, a latching device (6) and an unlatching actuator (7). The latching device includes a pressing portion (62) and a latch portion (61) interlocking with a complementary connector. The unlatching actuator includes a mounting portion (71), an actuating portion (72) contoured to conform with the pressing portion and a pair of guiding portions (73) each extending into a corresponding groove (562) defined in the cover and each terminating with a handling portion (74) for conveniently handling. When the unlatching actuator is moved with respect to the latching device, the pressing portion is depressed such that the latch portion is disengaged from the complementary connector.

13 Claims, 11 Drawing Sheets

CABLE END CONNECTOR HAVING A LATCHING DEVICE AND AN UNLATCHING ACTUATOR

CROSS-REFERENCE TO RELATED APPLICATIONS

This application is related to U.S. patent application Ser. No. 10/776,111 filed on Feb. 10, 2004 and entitled "CABLE END CONNECTOR HAVING LOCKING DEVICE" and U.S. patent application Ser. No. 10/797,979 filed on Mar. 10, 2004 and entitled "CABLE END CONNECTOR HAVING LOCKING DEVICE", both of which have the same applicant and assignee as the present invention.

BACKGROUND OF THE INVENTION

1. Field of the Invention

The present invention relates to a cable end connector, and particularly to a cable end connector having a latching device for locking/unlocking with a complementary connector.

2. Description of Related Art

There exists in the art an cable end connector known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration.

Generally, the serial ATA connector comprises an insulative housing, a plurality of contacts assembled to the housing, a plurality of wires electrically connecting with the contacts, and a latching device for providing a reliable mechanical and electrical connection with a complementary connector. U.S. Pat. Nos. 6,655,979 and 6,585,536, having the same inventor and the same assignee with the present invention, each disclose a serial ATA connector equipped with a latching device. The latching device comprises a middle portion retained on a connector housing, a pushing portion extending rearwardly from the middle portion, and a locking portion extending forwardly from the middle portion for locking/releasing the Serial ATA connector with/from the complementary connector. When the cable end connector is to be disengaged with the complementary connector, a downward pressing force is exerted on the pushing portion to drive the pushing portion move a big enough distance. The locking portion then is forced to move a vertical displacement towards the housing and disengage with the complementary connector.

However, in a situation where the plurality of wires of the cable end connector disposed near the latching device extend in a direction perpendicular to or angular with a mating direction of the cable end connector assembly, when attempting to separate the cable end connector from the complementary connector, it is inconvenient or even difficult for a user to hold the cable end connector and operate the latching device.

Hence, an improved cable end connector having an actuator is desired to overcome the disadvantages of the prior art.

SUMMARY OF THE INVENTION

Accordingly, the object of the present invention is to provide a cable end connector having an unlatching actuator for driving a latching device to disengage with or further separate from a complementary connector conveniently.

To achieve the above object, a cable end connector in accordance with the present invention comprises an insulative housing comprising a front engaging portion and a rear terminating portion, a number of contacts received in the insulative housing, a cover mechanically mounted to the terminating portion of the insulative housing, a number of vertically extending wires electrically connecting with corresponding contacts and sandwiched between the housing and the cover, a latching device, and an unlatching actuator. The latching device is operatively assembled to the housing and comprises a pressing portion and a latch portion adapted to interlock with the complementary connector. The unlatching actuator comprises a mounting portion slidably mounted to the housing, an actuating portion contoured to conform with the pressing portion and a pair of guiding portions each extending into a corresponding groove defined in the cover and each terminated with a handling portion for conveniently handling. When the unlatching actuator is moved with respect to the latching device, the pressing portion of the latching device is depressed such that the latch portion is disengaged from the complementary connector. When the unlatching actuator is further pulled, the cable end connector is detached from the complementary connector.

Other objects, advantages and novel features of the invention will become more apparent from the following detailed description when taken in conjunction with the accompanying drawings.

DETAILED DESCRIPTION OF THE INVENTION

Figure 1:
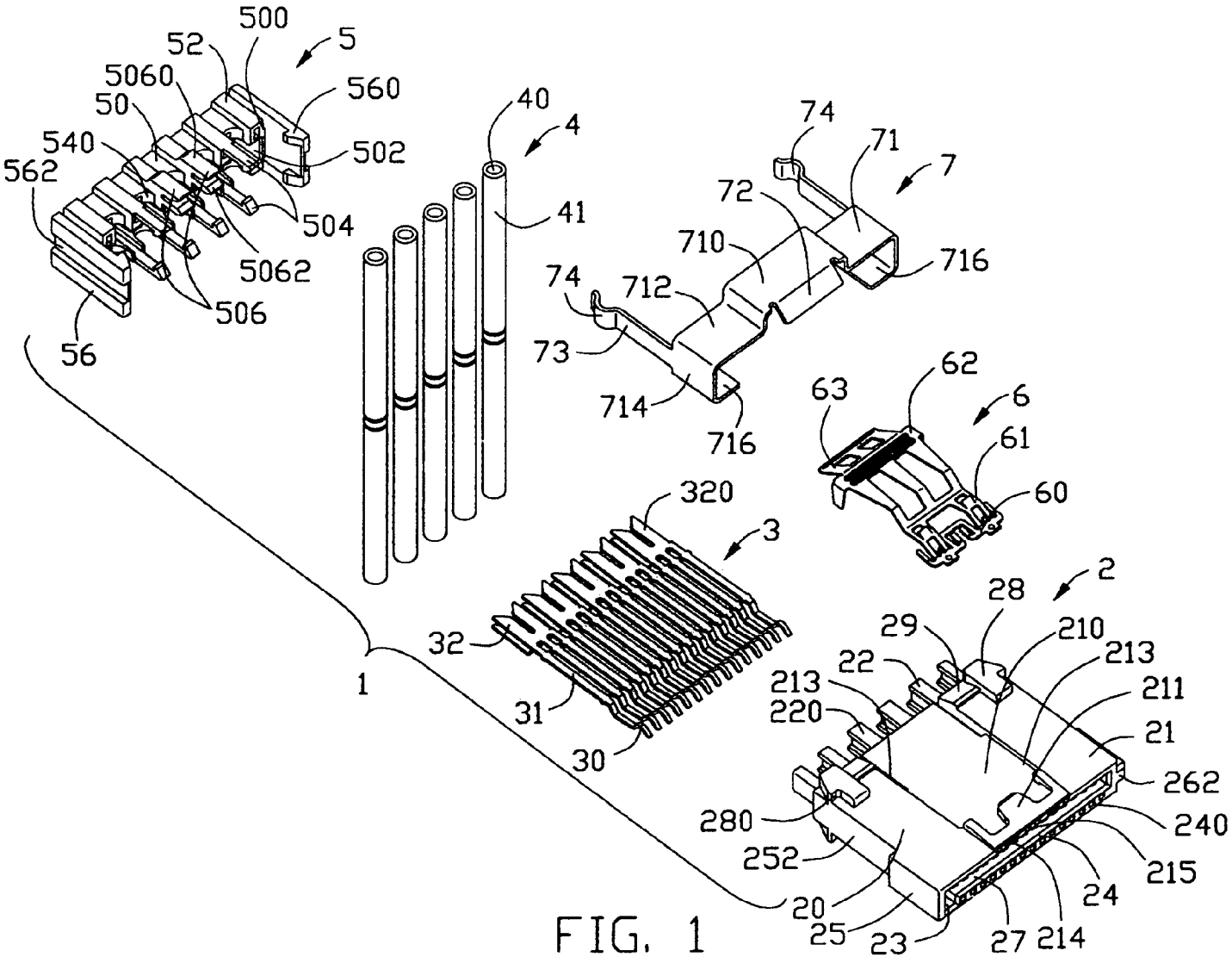
FIG. 1 is an exploded, perspective view of a cable end connector in accordance with the present invention.

Referring to FIGS. 1–4, a cable end connector 1 in accordance with the present invention comprises an insulative housing 2, a plurality of contacts 3, a plurality of wires 4, an insulative cover 5, a latching device 6 and a unlatching actuator 7. In a preferred embodiment, the cable end connector 1 is a power cable end connector.

Figure 3:
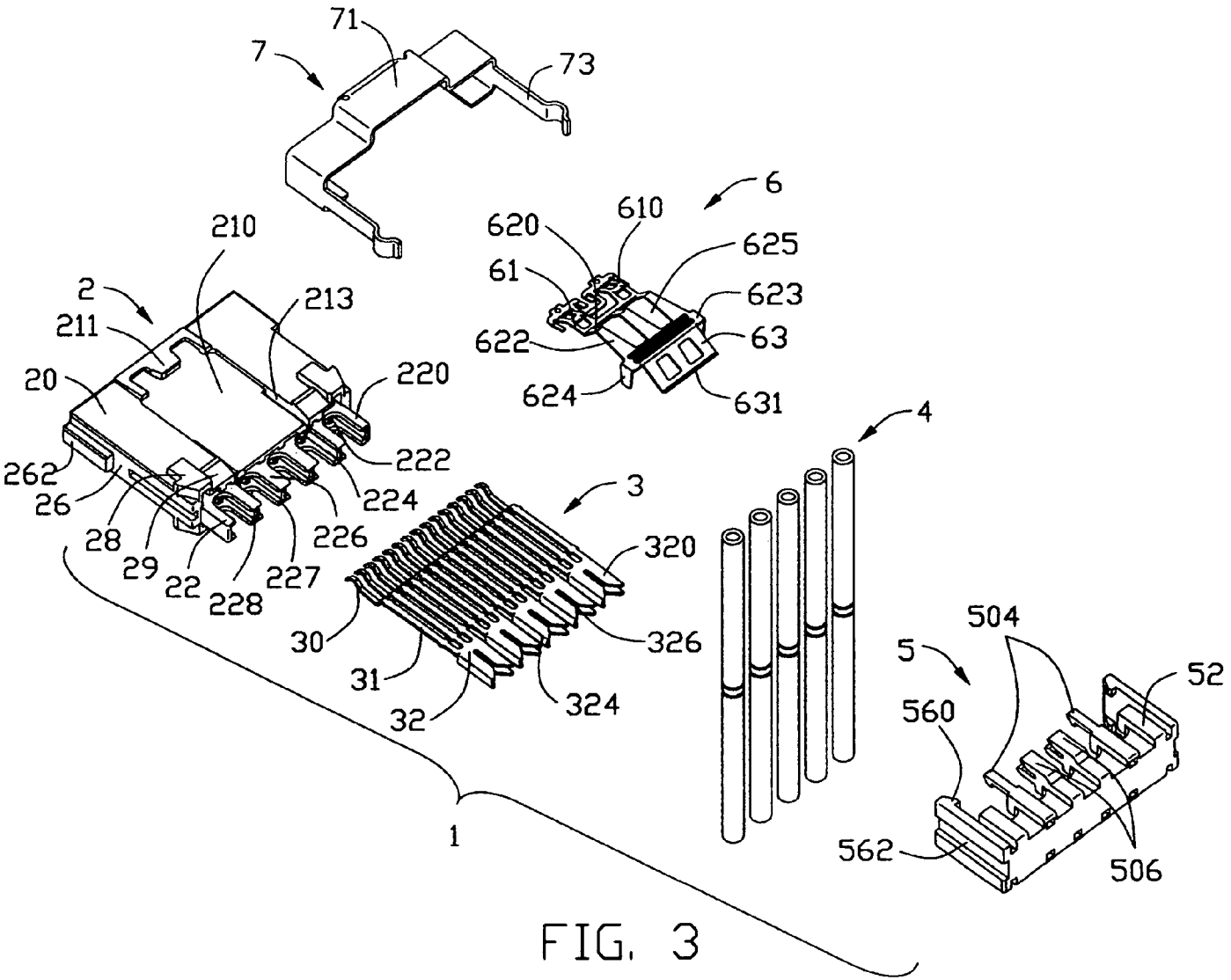
Figure 4:
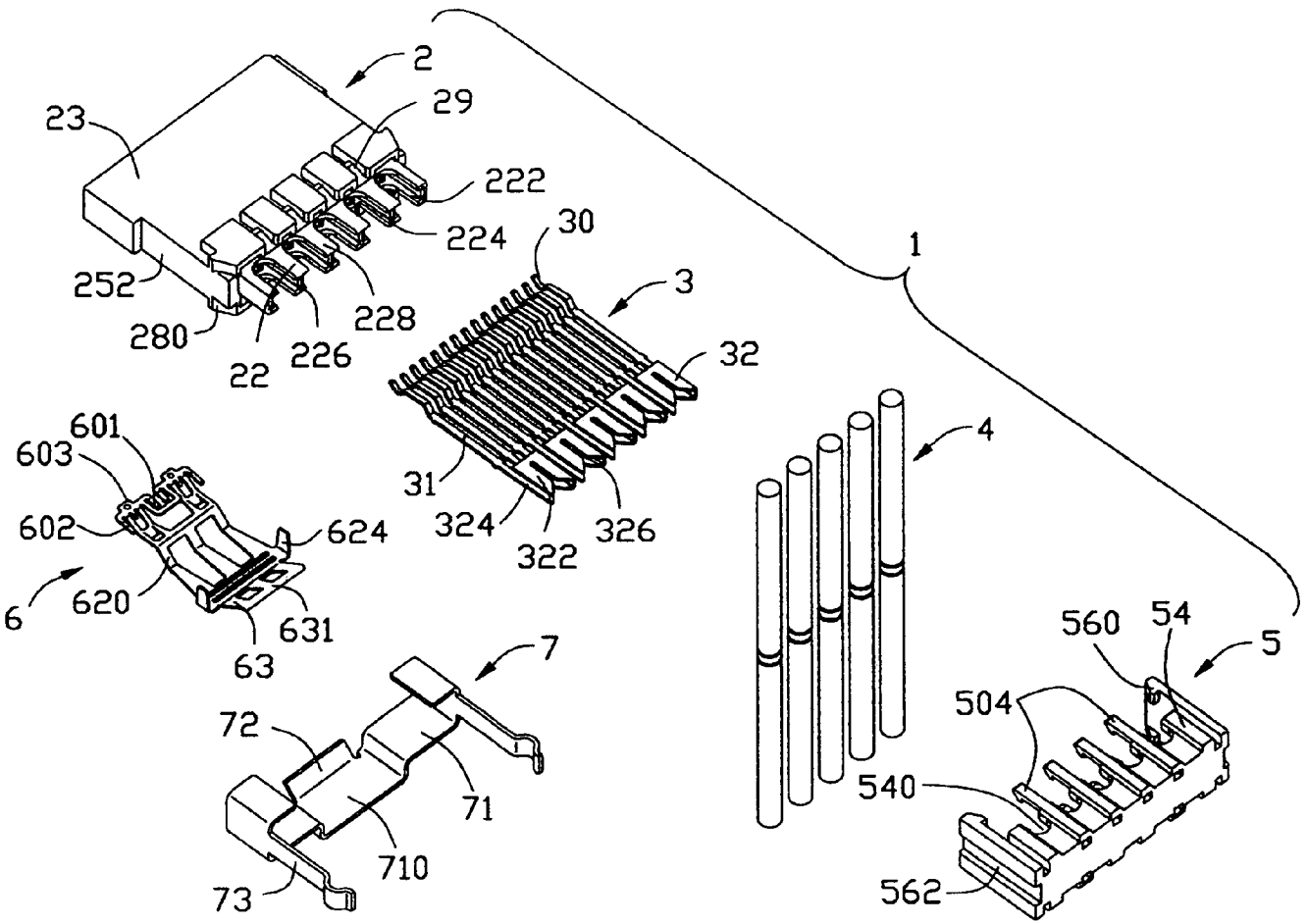

The insulative housing 2 comprises a front engaging portion 20 and a rear terminating portion 22. The front engaging portion 20 comprises an upper wall 21, a lower wall 23 opposite to the upper wall 21, and a pair of first and second sidewalls 25, 26 connecting with the upper wall 21 and the lower wall 23. The first sidewall 25 defines a recess 252 at a rear portion thereof. The second sidewall 26 forms a guiding projection 262 projecting outwardly for guiding a proper insertion of a complementary connector. An L-shaped receiving space 27 is defined between the upper and the lower walls 21, 23. A block 24 is formed on the lower wall 23 and protrudes into the receiving space 27. The block 24 defines a plurality of passageways 240 for receiving the contacts 3. The upper wall 21 defines a depression 210 on an upper surface thereof. A slant portion 211 extends rearwardly from a middle portion of a front edge of the upper wall 21 into the depression 210. A slit (not labeled) is formed between the slant portion 211 and a bottom surface of the depression 210. The upper wall 21 defines a pair of housing grooves 213 extending along opposite inner sides of the depression 210. A pair of first slots 214 and a pair of second slots 215 extend rearwardly from a front face of the slant portion 211 and communicate with the slit, respectively. A plurality of protrusions 28 and hook portions 29 are respectively formed at opposite sides of the upper wall 21 and alternatively formed on the lower wall 23 adjacent to the rear edge of the engaging portion 20. The outmost protrusions 28 each form a claw 280 extending outwardly therefrom. As best shown in FIG. 3, the rear terminating portion 22 has a plurality of rearwardly projecting posts 220 and every two neighboring posts 220 together define a U-shaped contact-receiving tunnel 222. Each post 220 comprises a pair of opposite walls 226, 227 and a clapboard 228 which together define a pair of channels 224 respectively on opposite sides of the clapboard 228 and each communicating with a neighboring contact-receiving tunnel 222.

Figure 2:
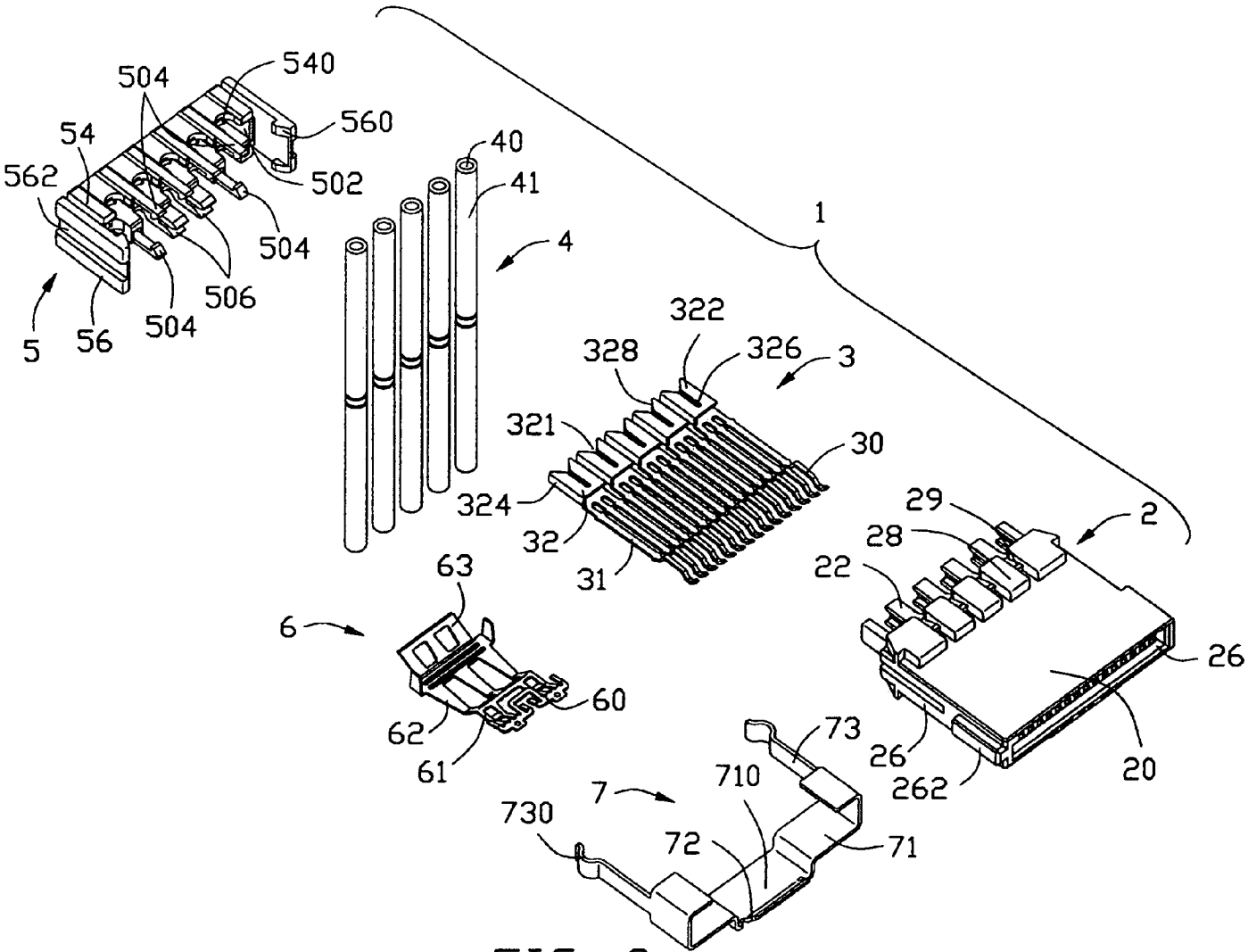
FIGS. 2–4 are views similar to FIG. 1, but taken from different aspects.

Particularly referring to FIG. 2, each contact 3 has a fork-shaped configuration and comprises a three-beam mating portion 30, a three-beam connecting portion 31 extending rearwardly from the mating portion 30, and an insulation displacement portion 32 extending rearwardly from the connecting portion 31 for electrically connecting with a corresponding wire 4. Each beam of the connecting portion 31 has a pair of barbs 310 on opposite sides thereof. The insulation displacement portion 32 comprises a first and a second walls 320, 322 and an intermediate section 324 connecting the first and the second walls 320, 322. The first wall 320 extends rearwardly from the connecting portion 31. Each wall 320, 322 defines an elongated slot 326 therein. The walls 320, 322 are oppositely configured such that the slots 326 are aligned with each other, whereby the wire 4 can be inserted into the slots 326 of both walls 320, 322 and remains substantially straight. Each wall 320, 322 has a pair of opposite inwardly inclined edges 328 at a rear end thereof, thereby forming an entry 321 communicating with the slot 326.

Each wire 4 comprises an inner conductor 40 and an outer insulator 41.

Figure 8:
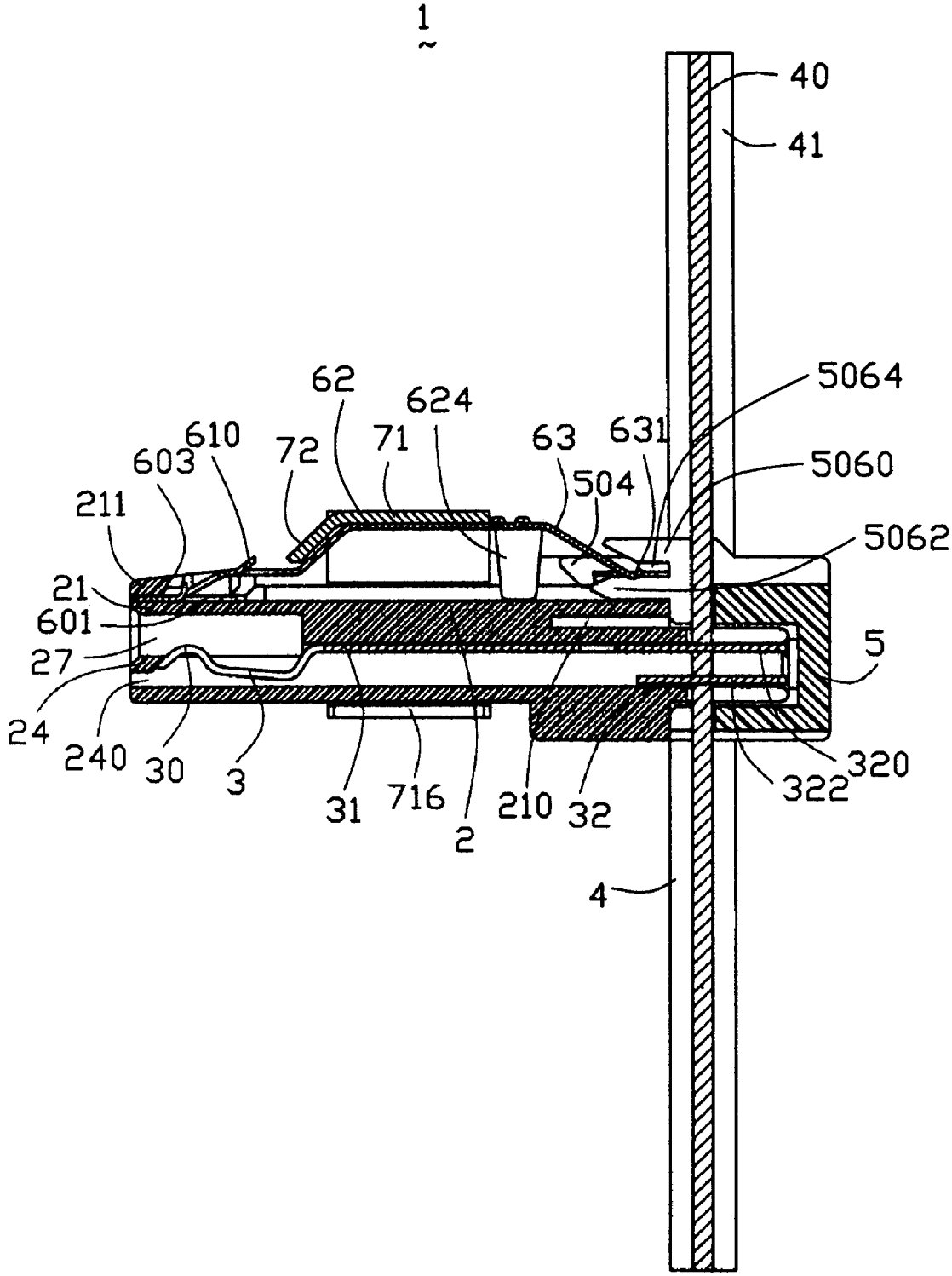
FIG. 8 is a cross-sectional view taken along lines 8—8 of FIG. 7.
Figure 9:
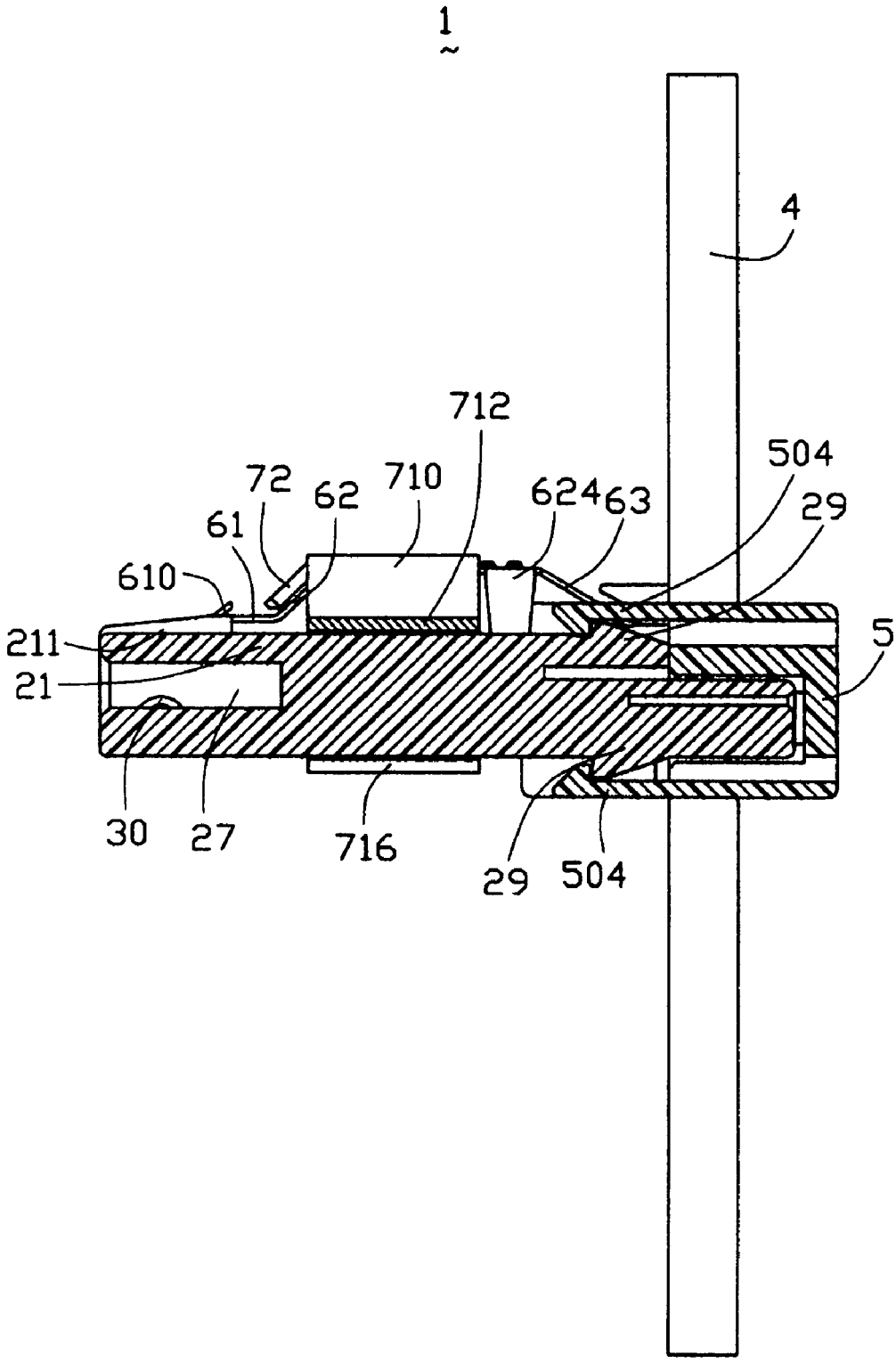
FIG. 9 is a cross-sectional view taken along line 9—9 of FIG. 7.
Figure 10:
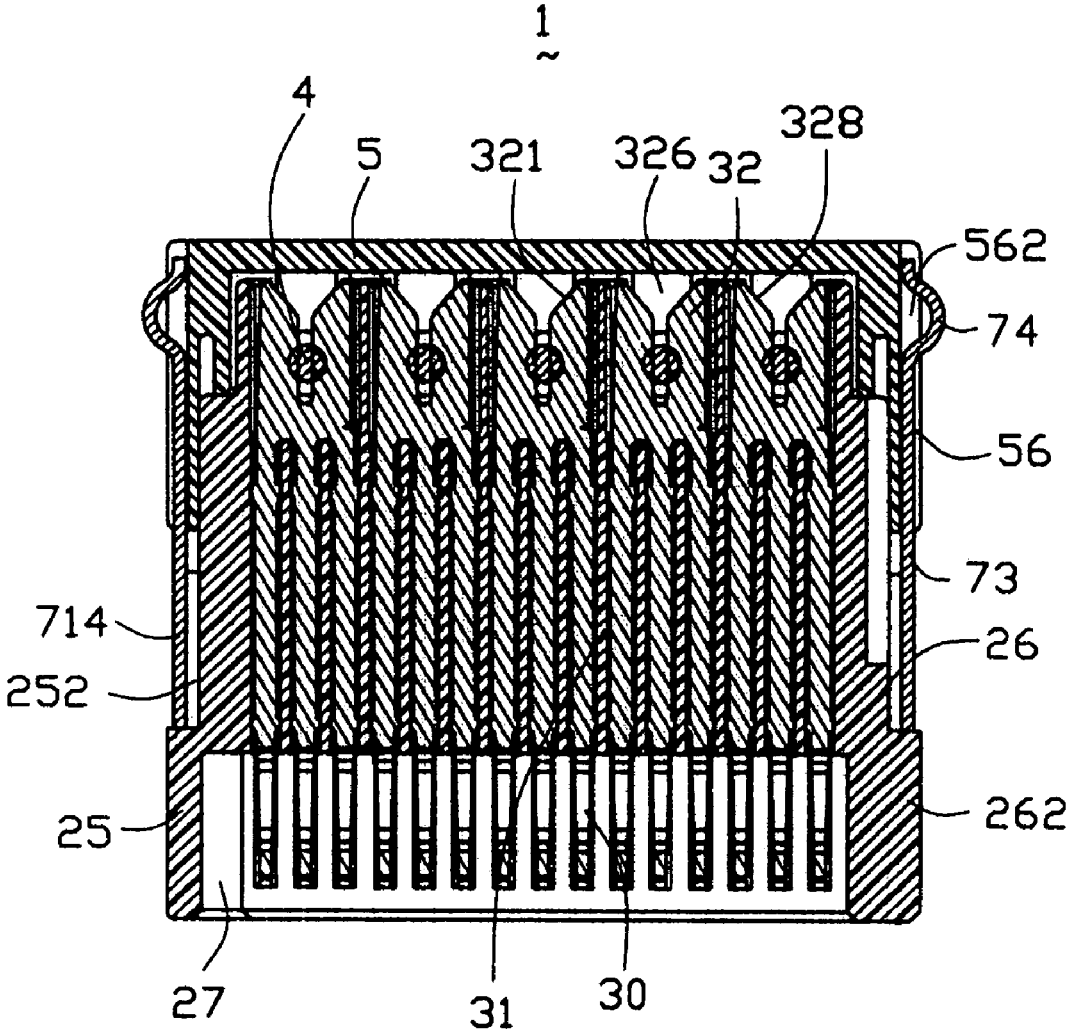
FIG. 10 is a cross-sectional view taken along line 10—10 of FIG. 7.

The insulative cover 5 comprises a body 50 having opposite top and bottom walls 52, 54 and a pair of lateral walls 56 partially extending forwardly beyond a front surface 500 of the body 50. The body 50 defines a plurality of receiving cavities 502 recessing rearwardly from the front surface 500 thereof and between the top wall 52 and the bottom wall 54. A plurality of latching arms 504 respectively extend forwardly from side portions of the top wall 52 and the bottom wall 54 and beyond the front surface 500 corresponding to the hook portions 29 of the insulative housing 2. A plurality of nipping portions 506 each having a fork-shaped front end extend forwardly from a middle portion of the top wall 52. Each fork-shaped front end comprises an upper and a lower clamping sections 5060, 5062 and defines a clamping hole 5064 (shown in FIG. 8) between the upper and the lower clamping sections 5060, 5062. The top and the bottom walls 52, 54 are both partially cutoff from adjacent to the front surface 500 to form a plurality of wire-receiving concaves 540 between every neighboring two of the latching arms 504 and the nipping portions 506. Each lateral wall 56 forms a pair of latches 560 at a distal end thereof for latching with the claws 280 of the outmost protrusions 28 of the insulative housing 2 and defines a receiving groove 562 extending therethrough from front to rear for engaging with the unlatching actuator 7.

The latching device 6 is stamped and formed of a metallic plate and comprises a retaining portion 60, a locking portion 61 extending rearwardly from the retention portion 60, a pressing portion 62 extending rearwardly and upwardly from the locking portion 61 and a supporting portion 63 extending rearwardly and downwardly from the pressing portion 62. The retaining portion 60 has a pair of bar sections 602 extending rearwardly from opposite ends thereof, a pair of snap sections 601 extending upwardly and rearwardly from a middle portion of a front end thereof and a pair of positioning sections 603 extending forwardly from the front end thereof. The locking portion 61 is formed with a pair of latch sections 610 upwardly warped from the retention portion 60. The pressing portion 62 is substantially L-shaped and comprises a bent section 620 rearwardly and upwardly extending from the locking portion 61, a flat section 622 rearwardly extending from the bent section 620, a holding section 623 having a plurality of ribs thereon, and a pair of bar sections 624 extending downwardly from opposite lateral ends of the holding section 623. The bent section 620 and the flat section 622 together define a pair of openings 625 for perfect deformation of the pressing portion 62. The supporting portion 63 has a curved edge 631 at a rear end thereof.

The unlatching actuator 7 is formed of a metallic plate and comprises a mounting portion 71, an actuating portion 72, a pair of guiding portions 73 and a pair of handling portions 74. The mounting portion 71 comprises a top wall 712 forming a ridge portion 710 at middle thereof, a pair of parietal walls 714 respectively extending from lateral edges of the top wall 712, and a pair of bottom walls 716 inwardly extending from a corresponding parietal wall 714. The actuating portion 72 extends frontwardly and downwardly from a front edge of the ridge portion 710 of the mounting portion 71. The guiding portions 73 respectively and rearwardly extend from a corresponding parietal wall 714. The handling portions 74 are respectively formed in arc and at a rear end of each guiding portion 73 for providing operators with convenient handling.

Referring to FIGS. 5–10 in conjunction with FIGS. 1–4, in assembly, the contacts 3 are inserted into the insulative housing 2 in a rear-to-front direction. The mating portions 30 of the contacts 3 are respectively received in front portions of the passageways 240 and are partially exposed in the receiving space 27 for electrically connecting with the complementary connector. The connecting portions 31 of the contacts 3 are respectively received in rear portions of the passageways 240 and the barbs 310 of each beam of the connecting portion 31 engage with opposite side surfaces of a corresponding passageway 240 for retaining the contacts 3 in the housing 2. The first and the second walls 320, 322 of the insulation displacement portion 32 are received in the channels 224 with the intermediate section 324 abutting against the clapboard 228 of the channel 224.

The wires 4 are respectively urged into the insulation displacement portions 32 of the contacts 3 then into the slots 326 through the entries 321 with the outer insulator 41 cut by the inwardly inclined edges 328, thereby the insulation displacement portion 32 connects with the inner conductor 40 and an electrical connection between the contacts 3 and the wires 4 is established.

The insulative cover 5 is then assembled to the insulative housing 2 with a rear face of the engaging portion 20 contacts the front face 500 of the cover 5. The posts 220 of the insulative housing 2 are respectively received in the receiving cavities 502 of the cover 5. The latching arms 504 respectively slide along inclined surfaces of the hook portions 29 and then snap onto the hook portions 29. The latches 560 of the lateral walls 56 engage with the claws 280 of the outmost protrusions 28 for enhancing the engagement between the cover 5 and the insulative housing 2. The two nipping portions 506 are placed in the depression 210 with bottom surfaces of the nipping portions 506 abutting against the bottom surface of the depression 210. The wires 4 are respectively received in the wire-receiving holes 540 to electrically connect with the insulation displacement portions 32 of the contacts 3 more reliably.

The latching device 6 is assembled to the insulative housing 2. The bar sections 624 are received and can be wing up and down in the housing grooves 213 of the insulative housing 2. The middle portion of the retaining portion 60 is received in the slit between the slant portion 211 and the bottom surface of the depression 210 with the positioning sections 603 and the snap sections 601 respectively locked with the first and the second slots 214, 215 to prevent the latching device 6 from moving rearwardly when the cable end connector 1 mates with the complementary connector. The supporting portion 63 is located over the bottom surface of the depression 210 of the housing 2 with the curved edge 631 received in the clamping holes 5064 between the first and the second clamping sections 5060, 5062 of the nipping portions 506. The curved edge 631 is attached to the second clamping sections 5062 and untouched the first clamping sections 5060, whereby being movable upwardly in the clamping holes 5064 when the pressing portion 62 of the latching device 6 is pressed down. The pressing portion 62 is downwardly movable with respect to the insulative housing 2 and the cover 5 to deflect the locking portion 61 toward the insulative housing 2.

The unlatching actuator 7 is then mounted on the housing 2 and the cover 5. The mounting portion 71 partially encloses the housing 2 with the ridge portion 710 attaching to the flat section 622 of the pressing portion 62 of the latching device 6 and the actuating portion 72 covering the bent section 620 of the pressing portion 62. One of the pair of parietal walls 714 is received in the recess 252 of the first sidewall 25 of the housing 2, and the other envelops the second sidewall 26 of the housing 2 and is stopped by the guiding projection 262 when moving frontwardly in a front-to-rear direction. The guiding portions 73 are extended into the receiving grooves 562 of the cover 5 and can be moved back and forth in the front-to-back direction in the receiving grooves 562. The handling portions 74 project out of the receiving grooves 562.

Figure 5:
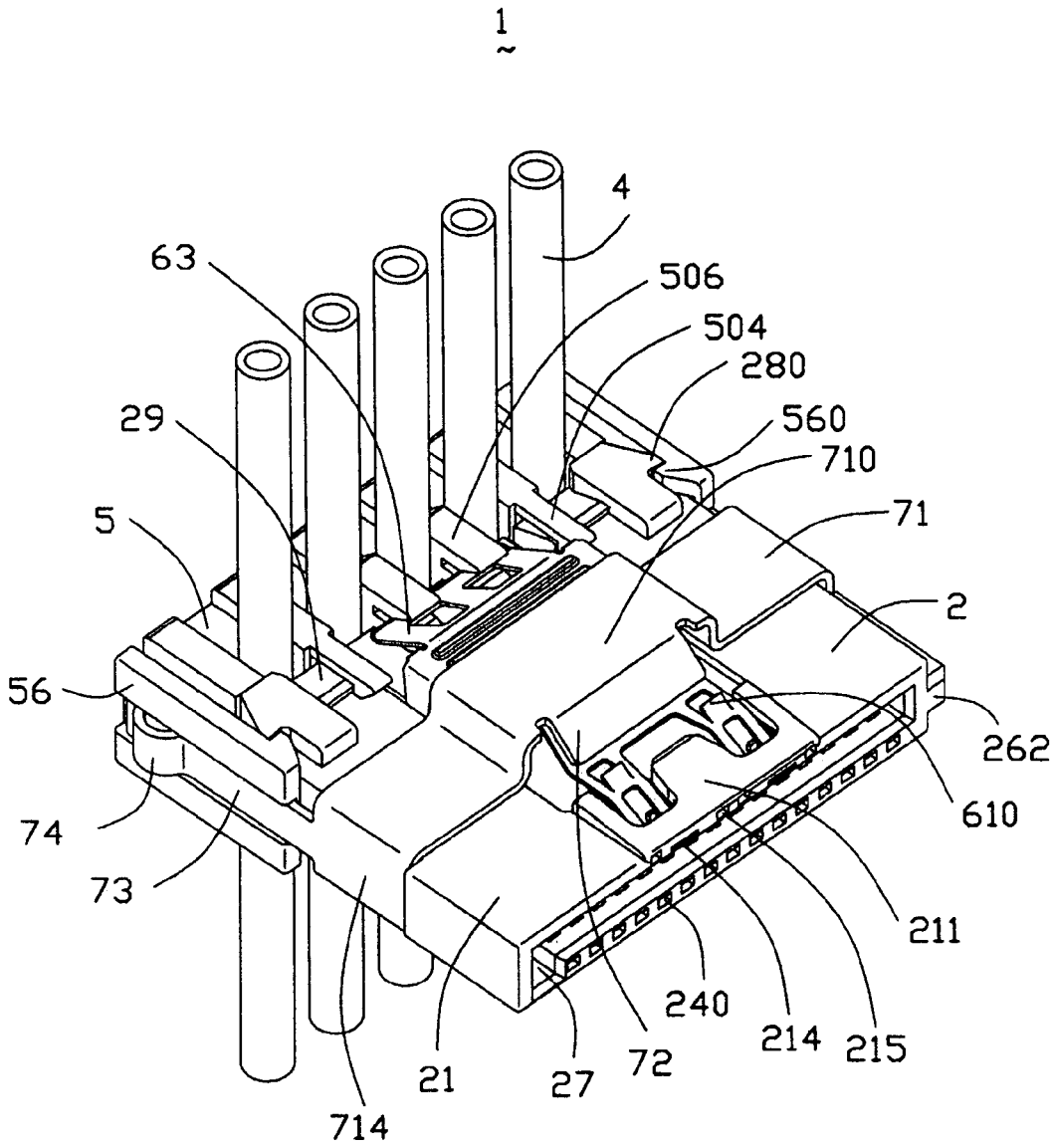
FIG. 5 is an assembled view of the cable end connector of FIG. 1.
Figure 6:
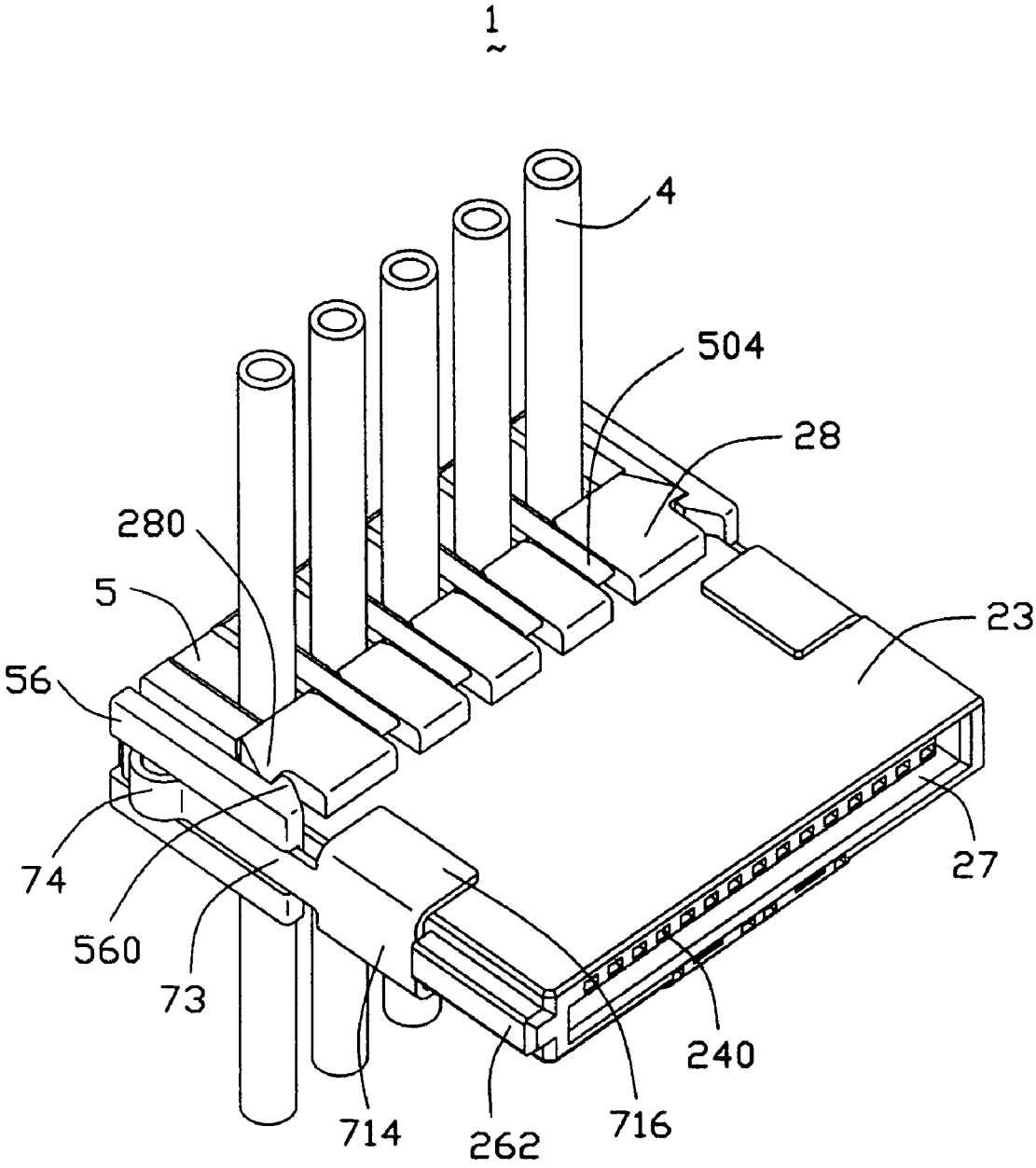
FIG. 6 is a view similar to FIG. 5, but taken from a different aspect.
Figure 7:
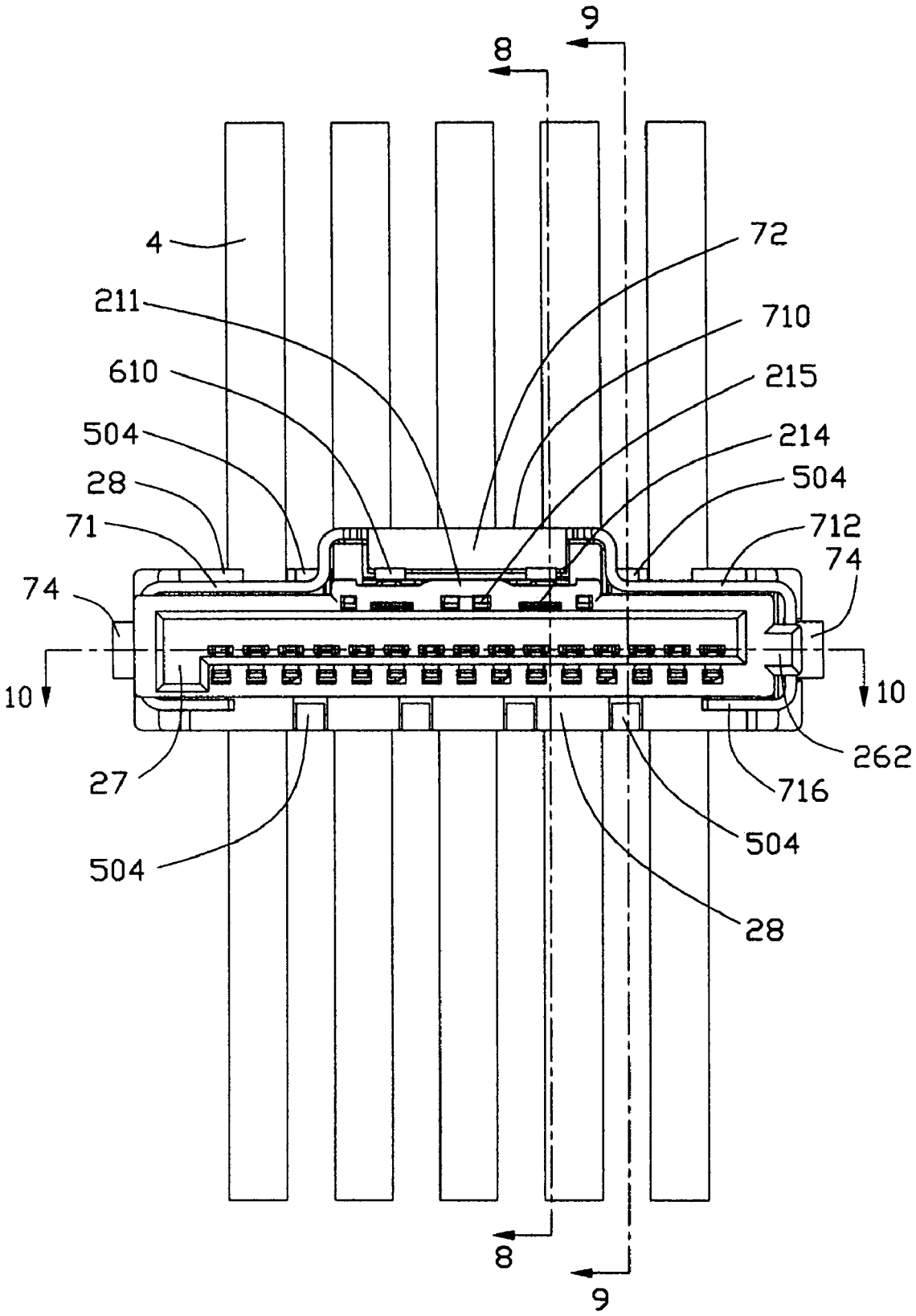
FIG. 7 is a front plan view of the cable end connector shown in FIG. 1.

Referring to FIG. 5, the cable end connector 1 when initially assembled is shown. The unlatching actuator 7 is situated at a first original position.

Figure 11:
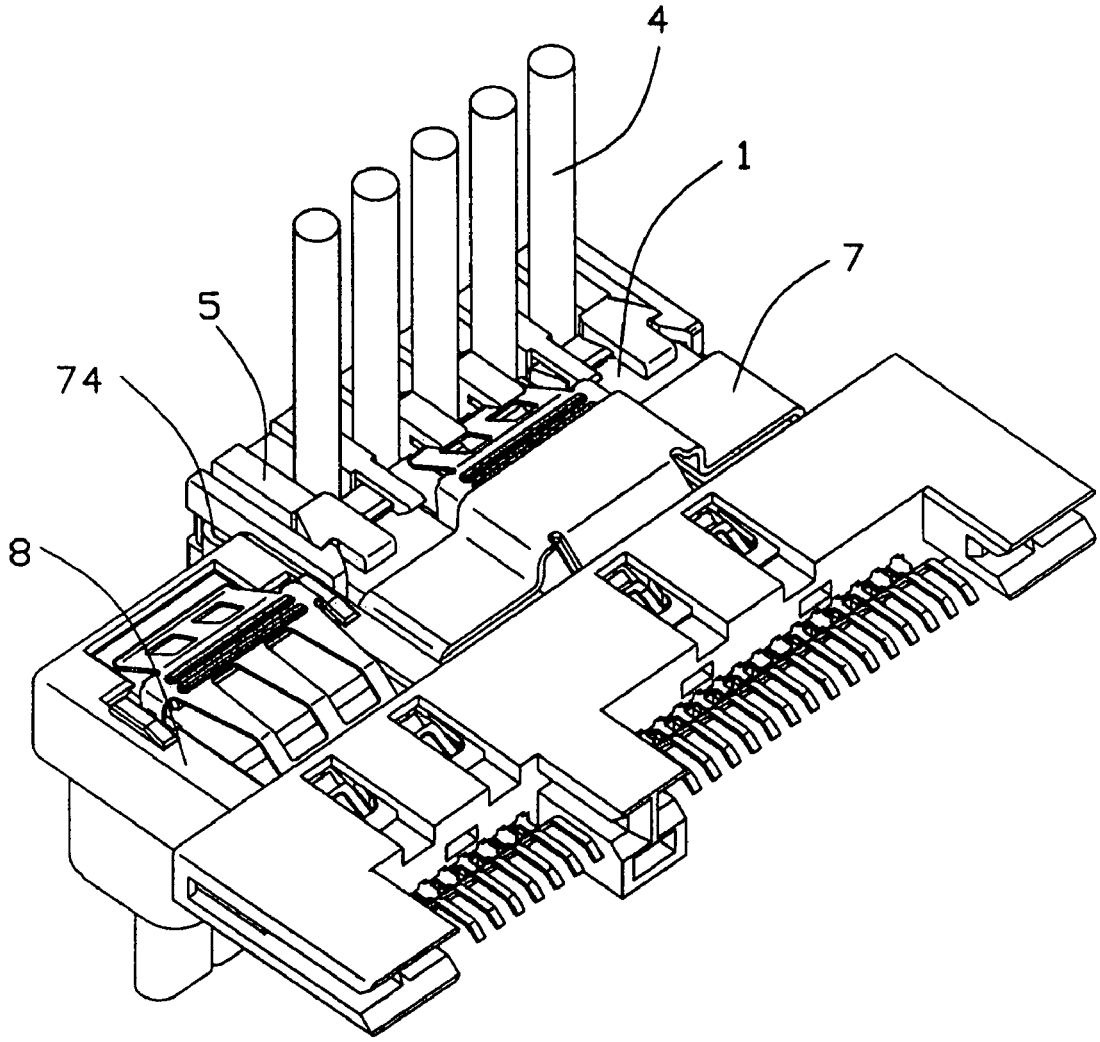
FIG. 11 is perspective view showing the application of the cable end connector of FIG. 1.

A preferred application situation for being mated with the complementary connector is shown in FIG. 11. The power cable end connector 1 is placed side-by-side with a signal cable end connector 8. There is almost no region for operator's holding the power cable end connector 1 due to the vertically extending cables 4 and the confined space between the power cable end connector 1 and the signal cable end connector 8. The unlatching actuator 7 is handily set force with handling portions 74 projecting out of a rear portion of the cover 5 for convenient handling.

Referring again to FIG. 5 in conjunction with FIG. 11, when the cable end connector 1 is to be disengaged with the complementary connector, a rearward pulling force is exerted on the handling portions 74 of the unlatching actuator 7. The unlatching actuator 7 is pulled under the pulling force from the first original position to a second disengagement position, and the actuating portion 72 is driven to move rearwardly to first attach to and finally depress the pressing portion 62 of the latching device 6 until the latching portion 61 of the latching device 6 is forced to downwardly move a big enough distance correspondingly to realize the unlocking between the cable end connector 1 and the complementary connector. When the handling portions 74 are further pulled, the unlatching actuator 7 is moved to a final separation position thereof with the parietal walls 714 abutting against the forefront of the cover 5. In this time, when the handling portions 74 are further pulled, a resistance is introduced between the parietal walls 714 and the cover 5 which stops the rearward movement of the unlatching actuator 7 with respect to the cover 5. Then the cable end connector 1 is pulled out of the complementary connector under the effect of said resistance. Therefore, the cable end connector 1 is successfully separated from the complementary connector. After separation, the pulling force is withdrawn, the metallic latching device 6 rebounds frontwardly and upwardly to an initial situation thereof due to the elasticity characteristic of its own. Accompanyingly, the unlatching actuator 7 is recovered to the first original position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector for mating with a complementary connector, comprising:

a housing;

a plurality of contacts assembled to the housing;

a latching device operatively assembled to the housing and comprising a pressing portion and a latch portion adapted to interlock with the complementary connector; and an unlatching actuator slidably assembled to the housing along a front-to-back direction and cooperating with the housing, the unlatching actuator having an actuating portion contoured to conform with the pressing portion and capable of sliding along the pressing portion;

wherein rearward movement of the unlatching actuator with respect to the housing results in rearward movement of the latching device together with the unlatching actuator firstly and deflection of the pressing portion of the latching device along a direction perpendicular to said front-to-back direction secondly such that the latch portion is disengaged from the complementary connector to separate the cable end connector from the complementary connector.

2. The cable end connector as claimed in claim 1, wherein the unlatching actuator is formed of a metallic plate.

3. The cable end connector as claimed in claim 2, wherein the unlatching actuator has a mounting portion assembled to a large main side of the housing and the latching device to partially cover the large main side of the housing and the latching device, and wherein the actuating portion extends forwardly from the mounting portion.

4. The cable end connector as claimed in claim 3, wherein the cable end connector further comprises an insulative cover assembled to a rear end of the housing and defining a receiving grove in at least one of opposite small sides of the cover, and wherein the unlatching actuator comprises at least one guiding portion connected with the mounting portion and slidably received in the receiving groove for guiding movement of the unlatching actuator.

5. The cable end connector as claimed in claim 4, wherein the unlatching actuator comprises at least one curved handling portion connected with the at least one guiding portion and exposed outside of the receiving groove of the cover for being actuated by user.

6. The cable end connector as claimed in claim 3, wherein the mounting portion comprises a first portion attaching to the latching device and higher than the pressing portion of the latching device and a second portion attaching to the housing and lower than the pressing portion of the latching device.

7. The cable end connector as claimed in claim 1, wherein the cable end connector further comprises a restriction portion formed with at least one of the housing and the insulative cover to restrict the rearward movement of the unlatching actuator and cooperate with the unlatching actuator to provide a force to overcome unmating force between the cable end connector and the complementary connector.

8. The cable end connector as claimed in claim 4, wherein the cover comprises a nipping portion having a fork-shaped front end for engaging with a rear flange of the latching device.

9. The cable end connector as claimed in claim 4, wherein the cable end connector comprises a plurality of vertically extending wires sandwiched between the housing and the cover.

10. The cable end connector as claimed in claim 4, wherein the cable end connector forms a plurality of latching arms with at least one of the housing and the insulative cover, and wherein the cable end connector further comprises a plurality of protrusions with at least one of the insulative cover and the housing to respectively latch with the latching arms to latch the housing with the cover.

11. The cable end connector as claimed in claim 1, wherein the contacts each comprise a three-beam mating portion received in the passageways, a three-beam connecting portion extending from the mating portion and a common insulation displacement portion extending from the connecting portion, and wherein the housing forms a plurality of front engaging portion defining a plurality of passageways to receive the mating portions of rearward extending posts forming a plurality of channels to receive the common insulation displacement portions of the contacts.

12. The cable end connector as claimed in claim 1, wherein the housing defines an L-shape receiving space for receiving the complementary connector and a guiding projecting outwardly from one lateral wall of the housing.

13. A cable end connector for mating with a complementary connector, comprising:

a housing defining a mating front opening and a front-to-back direction for mating;

a plurality of contacts disposed in the housing;

a plurality of cables attached to a rear portion of the housing and electrically connected to the corresponding contacts, respectively;

a latching section operatively assembled to the housing and comprising at least a latch portion adapted to interlock with the complementary connector, said latching section being essentially deflectable in a direction perpendicular to said front-to-back direction and inwardly toward the housing; and an unlatching section slidably assembled to the housing, said unlatching section being moveable along said front-to-back direction; wherein rearward movement of the unlatching section along said front-to-back direction results in deflection of said latching section for unlatching the connector from the complementary connector;

wherein said latching section is essentially located on a large main side of the housing instead of two opposite small sides perpendicular to said large main side;

wherein said cables extend along said deflection direction;

wherein said latching section and said unlatching section are discrete from while overlapped with each other;

wherein said unlatching section includes a pair of operation portions on said two sides of the housing, respectively, for manually rearwardly moving the unlatching section;

wherein said unlatching section including an actuation portion moveably engaged with the latching section so as to result in said deflection of the latching section.

* * * * *